US009982414B2

(12) United States Patent
Jang

(10) Patent No.: US 9,982,414 B2
(45) Date of Patent: May 29, 2018

(54) OPERATION IDENTIFICATION OF A WORK MACHINE

(71) Applicant: CATERPILLAR INC., Peoria, IL (US)

(72) Inventor: Tai Seung Jang, Champaign, IL (US)

(73) Assignee: Caterpillar Inc., Deerfield, IL (US)

( * ) Notice: Subject to any disclaimer, the term of this patent is extended or adjusted under 35 U.S.C. 154(b) by 71 days.

(21) Appl. No.: 15/155,615

(22) Filed: May 16, 2016

(65) Prior Publication Data

US 2017/0328031 A1 Nov. 16, 2017

(51) Int. Cl.
*E02F 9/20* (2006.01)
*E02F 9/26* (2006.01)

(52) U.S. Cl.
CPC ..... *E02F 9/2029* (2013.01); *E02F 9/2025* (2013.01); *E02F 9/2041* (2013.01); *E02F 9/2058* (2013.01); *E02F 9/267* (2013.01)

(58) Field of Classification Search
CPC ..... E02F 9/2029; E02F 9/2058; E02F 9/2041; E02F 9/2025; E02F 9/267
See application file for complete search history.

(56) References Cited

U.S. PATENT DOCUMENTS

2006/0243180 A1 11/2006 Sundermeyer et al.
2009/0228177 A1 9/2009 Mintah et al.
2012/0317444 A1* 12/2012 Suzuki ..... E02F 9/2025 714/39
2014/0067092 A1* 3/2014 Cesur ..... E02F 9/2025 700/83
2017/0249562 A1* 8/2017 Garvey ..... G06N 99/005

* cited by examiner

*Primary Examiner* — Mary D Cheung
(74) *Attorney, Agent, or Firm* — Finnegan, Henderson, Farabow, Garrett & Dunner, LLP

(57) ABSTRACT

Systems and methods are disclosed for identifying operations of a machine. The system includes a work tool and an operator input device configured to receive input indicative of a desired movement of the work tool and to generate a command data stream associated with the received input. The system also includes an actuator configured to move the work tool according to the command data stream and a controller in communication with the operator input device and the actuator. The controller is configured to convert the command data stream into a frequency data stream and identify a pattern in the frequency data stream. The controller is also configured to make a classification of a current operation of the machine as one of a plurality of known operations based on the identified pattern. The controller is further configured to trigger an event associated with the current operation of the machine.

20 Claims, 3 Drawing Sheets

OPERATION IDENTIFICATION OF A WORK MACHINE

TECHNICAL FIELD

The present disclosure relates generally to systems and methods for identifying the operation of a work machine, and more particularly, to systems and methods for identifying the operation of a work machine using information from an operator input device.

BACKGROUND

Modern work machines such as hydraulic excavators, backhoe loaders, wheel loaders, and skid-steer loaders, are used for a variety of tasks requiring operator control of the work machine and various work tools associated with the work machine. These work machines and work tools can be relatively complicated and difficult to operate. They may have an operator interface with numerous controls for steering, position, orientation, transmission gear ratio, and travel speed of the work machine, as well as position, orientation, depth, width, and angle of the work tool.

Typically, these work machines employ joystick-based control systems for achieving the desired manipulation of the work tool using precise movements of an implement. The physical positioning of different parts of the implement, such as boom and stabilizer, may be controlled using one or more hydraulic systems. The hydraulic systems may be operated by one or more control pods, each having a joystick disposed thereon. For example, an excavator may employ one joystick for stick and swing control, and another joystick for boom and bucket control.

Understanding the operation of a work machine has several usages. One usage is to improve in real-time the productivity and efficiency of a work machine. For example, it may be desirable to increase the acceleration limits imposed on the extending movement of an actuator when a certain operation, such as dig operation, is identified.

One attempt to improve the performances of a work machine is disclosed in U.S. Pat. No. 7,539,570 to Normarm (the '570 patent). The '570 patent provides a system and method for controlling a work machine. The disclosed system includes sensors configured to sense at least one operational characteristic of the machine indicative of an application of the work tool, and a control unit configured to alter the operation of the machine in response to a new application of the work tool.

Although the method and system of the '570 patent may provide information useful for improving the performances of a work machine, it may still be less than optimal. In particular, the '570 patent relies on data from expensive sensors and analyzes data from the operator input device. Because work machines perform a wide variety of tasks, the partial solution of the '570 patent cannot accurately identify all the activities of the work machine.

The disclosed analysis system is directed to overcoming one or more of the problems set forth above.

SUMMARY

In one aspect, the present disclosure is directed to a control system for a machine. The control system includes a work tool and an operator input device configured to receive input indicative of a desired movement of the work tool and to generate a command data stream associated with the received input. The control system also includes at least one actuator configured to move the work tool according to the command data stream and a controller in communication with the operator input device and the at least one actuator. The controller is configured to convert the command data stream into a frequency data steam and to identify a pattern in the frequency data stream. The controller is also configured to make a classification of a current operation of the machine as one of a plurality of known operations based on the identified pattern. The controller is further configured to trigger an event associated with the current operation of the machine.

In another aspect, the present disclosure is directed to a method for identifying operations of a machine. The method includes receiving a command data stream from at least one machine having an operator input device for controlling movements of the machine, wherein the command data stream is associated with a period of time. The method further includes converting the command data stream into a frequency data stream, and identifying a plurality of patterns in the frequency data stream. The method also includes making classifications of a plurality of previous operations of the machine that happened in the period of time as one or more of a plurality of known operations based on the identified plurality of patterns. The method further includes using the classifications to generate a machine application profile.

In yet another aspect, the present disclosure is directed to a computer programmable medium having executable instructions stored thereon for completing a method identifying operations of a machine. The method includes receiving a command data stream from at least one machine having an operator input device for controlling movements of the machine, wherein the command data stream is associated with a period of time. The method further includes converting the command data stream into a frequency data stream, and identifying a plurality of patterns in the frequency data stream. The method also includes making classifications of a plurality of previous operations of the machine that happened in the period of time as one or more of a plurality of known operations based on the identified plurality of patterns. The method further includes using the classifications to generate a machine application profile.

DETAILED DESCRIPTION

Figure 1:
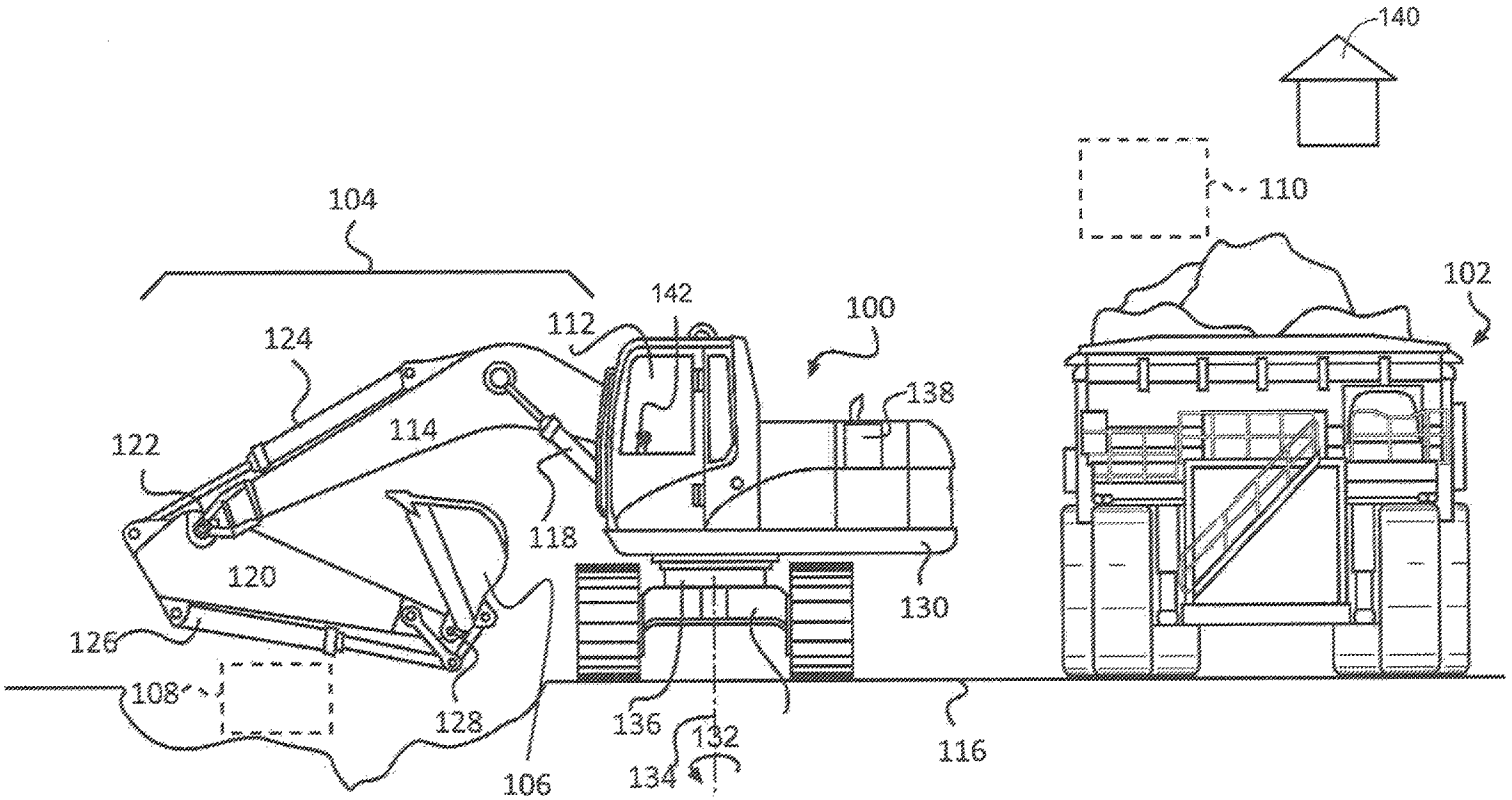
FIG. 1 is a diagrammatic illustration of an exemplary disclosed, work machine.

FIG. 1 illustrates an exemplary machine 100 having multiple systems and components that cooperate to excavate and load earthen material onto a nearby haul vehicle 102. In one example, machine 100 may embody a hydraulic excavator. It is contemplated, however, that machine 100 may embody another type of machine such as a backhoe, a front shovel, a dragline excavator, or another similar machine. Machine 100 may include, among other things, an implement 104 configured to move a work tool 106 between a dig location 108 within a trench and a dump location 110 over haul vehicle 102, and an operator station 112 for manual control of implement 104.

Implement 104 may include a linkage structure acted on by fluid actuators to move work tool 106. Specifically, implement 104 may include a boom 114 that is vertically pivotal relative to a work surface 116 by a pair of adjacent hydraulic actuators 118 (only one shown in FIG. 1). Implement 104 may also include a stick 120 that is vertically pivotal about a horizontal axis 122 by a single hydraulic actuator 124. Implement 104 may further include a single hydraulic actuator 126 operatively connected to work tool 106 to pivot work tool 106 vertically about a horizontal pivot axis 128. Boom 114 may be pivotally connected to a frame 130 of machine 100. Frame 130 may be pivotally connected to an undercarriage member 132, and swung about a vertical axis 134 by a swing motor 136. Stick 120 may pivotally connect boom 114 to work tool 106 by way of pivot axes 122 and 128. It is contemplated that a greater or lesser number of actuators may be included within implement 104 and/or connected in a manner other than described above, if desired.

Machine 100 may also include an engine 138 configured to provide power to move undercarriage member 132 and may include one or more power sources, such as internal combustion engines, electric motors, fuel cells, batteries, ultra-capacitors, electric generators, and any other power source which would be known by a person having ordinary skill in the art. Engine 138 may further be used to power various functions of a work tool 106 or any other elements and subsystems associated with machine 100 and/or work tool 106.

Numerous different work tools 106 may be attachable to a single machine 100 and controllable via operator station 112 or via a remote control station 140. Work tool 106 may include any device used to perform a particular task such as, for example, a bucket, a fork arrangement, a blade, a shovel, or any other task-performing device known in the art. Although work tool 106 is connected, in the embodiment of FIG. 1, to pivot relative to machine 100, work tool 106 may alternatively or additionally rotate, slide, swing, lift, or move in any other manner known in the art.

Operator station 112 and remote control station 140 may be configured to receive input from a machine operator indicative of a desired machine and/or work tool movement. Specifically, operator station 112 and remote control station 140 may include one or more operator input devices 142 embodied as single or multi-axis joysticks. In one embodiment, operator input devices 142 may be a wheel configured to control undercarriage member 132 and/or the rotation of frame 130 relative to vertical axis 134. In another exemplary embodiment, operator input devices 142 may be proportional-type controllers configured to position and/or orient work tool 106 by producing a command data stream that is indicative of a desired work tool speed and/or force in a particular direction. The command data stream may be used to actuate any one or more of hydraulic actuators 118, 124, 126 and/or swing motor 136. It is contemplated that different operator station 112 and remote control station 140 may include one or more operator input devices 142, such as, for example, wheels, knobs, push-pull devices, switches, pedals, and other operator input devices known in the art.

Machine 100 may include an on-board system for directly monitoring and controlling in real-time the operation of machine 100. Additionally or alternatively, machine 100 may communicate with an off-board system located in a back office (e.g., remote control station 140) for monitoring and controlling the operation of machine 100.

Figure 2:
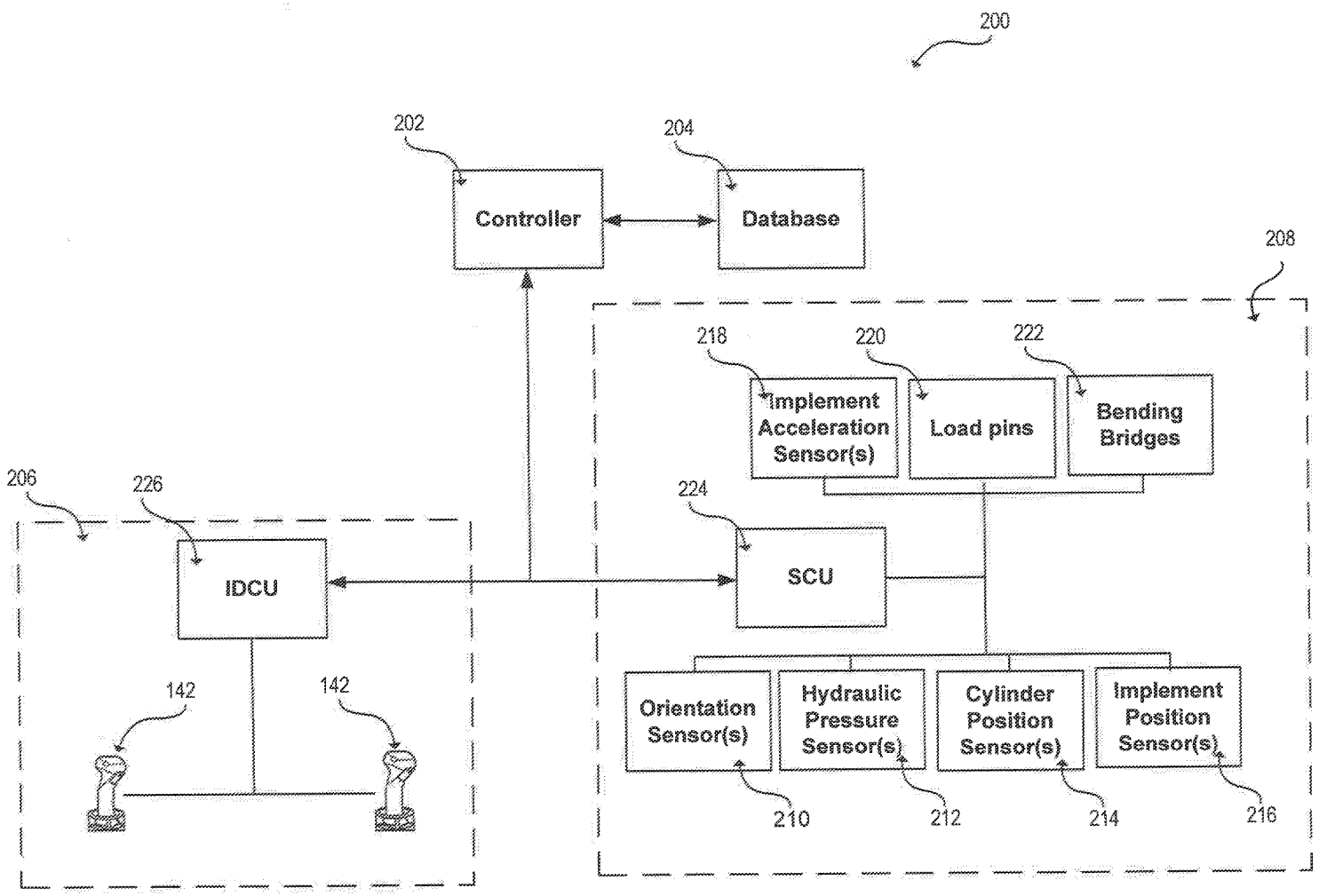
FIG. 2 is a schematic illustration of an exemplary disclosed system that may be used with the machine of FIG. 1.

FIG. 2 shows an exemplary system 200 consistent with certain disclosed embodiments. System 200 may be configured to perform health and usage monitoring functions associated with the operation of machine 100. In one embodiment, system 200 may be located on-board machine 100 and may process data in real-time to trigger an event, such as adjusting an operational parameter of an actuator. In another embodiment, system 200 may be located off-board and may communicate with machine 100. For example, system 200 may be part of a remote server that receives information from a plurality of machines 100 and uses the information to perform machine application profiling. Other aspects of system 200 may be implemented by the disclosed embodiments as described below.

In the exemplary embodiment shown, the system 200 includes a controller 202 and a memory component, such as a memory 204. System 200 may be connected to or communicate with an input network 206 and a sensor network 208. Input network 206 may include one or more operator input devices 142 and be configured to generate a command data stream associated with input received from the operator and indicative of the desired movements of machine 100 and/or the desired movements of work tool 106. Sensor network 208 may include sensors for detecting different aspects of machine 100. For example, sensor network 208 may detect hydraulic pressures in actuators, positions of cylinder rods, implement linkage angles, velocities and accelerations, steering articulation angles, strain on bolts forming structural joints, vehicle ground speed, inclinations relative to the Earth, and forces on instrumented pins in linkages and other structures.

In some embodiments, the various components in system 200 may be coupled by one or more communication buses or signal lines. Alternatively, some of the components in system 200 may be wirelessly connected to other components. For example, when controller 202 is located at a remote location (e.g., remote control station 140) it may receive information from input network 206 and sensor network 208 over a communication network. While a single illustration of system 200 is illustrated in FIG. 2, numerous variations and/or modifications may be made. Moreover, the components of system 200 may be arranged into a variety of configurations while providing the functionality of the disclosed embodiments. Therefore, the configuration of system 200, as illustrated in FIG. 2, should be considered as illustrative only, with a true scope and spirit being indicated by the following claims and their full scope of equivalents.

Controller 202 may be configured to receive data signals, process the data signals, and communicate data to memory 204. Controller 202 may include one or more processors (such as Digital Signal Processors (DSP)) configured to execute computer readable code that performs processes consistent with certain disclosed embodiments, such as functions to identify one or more activities of machine 100. In one exemplary embodiment, controller 202 may be associated with a data output device (not shown) that may display data from controller 202 and/or memory 204. The data output device could be a port connectable to a service tool, such as a laptop computer, a hand-held data device, and a wireless transmitter, among others. Controller 202 may include, for example, resources to process varying numbers of inputs. For instance, controller 202 may execute program code that stores data in a first-in-first-out buffer at maximum expected input sampling rates. Additionally, controller 202 may be configured to perform algorithms consistent with machine application profiling as disclosed herein. In one exemplary embodiment, controller 202 may process data through one or more neural networks, performing floating-point matrix calculations, etc. In addition, controller 202 may be associated with various other circuits, such as, power supply circuitry, signal conditioning circuitry, solenoid driver circuitry, and other types of circuitry.

Memory 204 may include one or more memory devices that store data and computer programs and/or executable code, including algorithms and data enabling processing of the data. Consistent with present disclosure, memory 204 may include any type of memory device(s) known in the art that is compatible with controller 202. Memory 204 also may be configured to store data calculated by controller 202 and may be configured to store computer programs and other information accessible by controller 202. In one exemplary embodiment, memory 204 may store historical data of machines 100 and associated machine application profiles. In addition, memory 204 is configured to update the associated machine application profiles with new determined information. In another embodiment, memory 204 may store neural network software that, when executed by controller 202, performs neural network processes consistent with the disclosed embodiments. A neural network is designed to mimic the operations of the human brain by determining the interaction between input and response variables based on a network of processing cells. The cells, commonly known as neurons or nodes, are generally arranged in layers, with each cell receiving inputs from a preceding layer and providing an output to a subsequent layer. The interconnections or links that transfer the inputs and outputs in a neural network are associated with a weight value that may be adjusted to allow the network to produce a predicted output value. Neural networks may provide predicted response values based on historical data associated with modeled data provided as independent input variables to the network. Neural networks may be trained by adjusting the data values associated with the weights of the network each time the historical data is provided as an input to allow the network to accurately predict the output variables. To do so, the predicted outputs are compared to actual response data of the system and weights are adjusted accordingly until a target response value is obtained.

Input network 206 may be configured to generate a command data stream from input received from one or more operator input devices 142. The command data stream may be indicative of the movements of machine 100 and/or the movements of work tool 106. In one embodiment, the one or more operator input devices 142 may be a first joystick lever controlling a first actuator and a second joystick lever controlling a second actuator. In this embodiment, input network 206 is configured to generate a single command data stream that includes information from both the first joystick and the second joystick. Sensor network 208 may be configured to collect data indicative of the state of machine 100. In one example, sensor network 208 may include one or more orientation sensors 210, one or more hydraulic pressure sensors 212, one or more cylinder position sensors 214, one or more implement position sensors 216, one or more implement acceleration sensors 218, load pins 220, and bending bridges 222. Generally, these may all be referred to as "sensors." Not all sensors are essential for the operation of system 200.

In general, the sensors implemented by machine 100 (e.g., sensors 210-218) may be separated into three categories: sensors that sense orientation and movement of machine 100, sensors that measure loads (e.g., cylinder pressure sensors, strain gauges on the rod ends of hydraulic actuators, etc.), and sensors that sense strain at some point, such as a sensor on a structural frame within machine 100. The number and position of the sensors implemented within machine 100 may depend on the type of machine, the type of component(s) within machine, the desired and actual use of machine 100, and other factors. For example, a certain number of sensors associated with the first two categories may be selectively positioned in order to provide adequate information to constrain the problem of generating the entire free body diagram of machine 100 or a machine component. The sensors from the third group, however, may be positioned in locations to provide a base set of measured data to compare to calculated strains (e.g., normal strain values). Further, based on the location of certain machine components or other sensors, a sensor positioned on these certain machine components may be wired or wireless.

Orientation sensors 210 may include one or more inclinometers disposed on machine 100 to measure one or both of pitch and roll of machine 100 relative to the Earth, Hydraulic pressure sensors 212 may be associated with a hydraulic system to detect fluid pressure. In one exemplary embodiment, pressure sensors 212 may be associated with a cylinder head of a hydraulic actuator. Hydraulic pressure sensors 212 may be disposed at other locations about machine 100 to measure hydraulic pressures. Hydraulic pressure sensors 212 may provide information regarding one or more forces acting on the structure of machine 100 at connection points of the hydraulic actuator.

Cylinder position sensors 214 may be configured to sense the movement and relative position of one or more components of machine 100, such as work tool 106. Cylinder position sensors 214 may be operatively coupled to actuators, such as hydraulic actuator 118, or to the joints connecting the various components of machine 100. Some examples of suitable position sensors 214 include, among others, length potentiometers, radio frequency resonance sensors, rotary potentiometers, machine articulation angle sensors and the like. Implement position sensors 216 may be associated with implement 104 in a manner to detect its position. In one exemplary embodiment, implement position sensors 216 are rotary position sensors disposed at pin connections on implement 104. Other position sensors also may be used including, among others, radio frequency resonance sensors, rotary potentiometers, angle position sensors, and the like. Implement acceleration sensors 218 may include an accelerometer or other type of sensor or sensors configured to monitor acceleration and may be associated with implement 104 in a manner to properly detect acceleration of any desired point. Velocities may also be obtained based on the time-derivative of position sensors for the bucket or other similar component of machine 100.

Load pins 220 may be configured to measure forces in x- and y-axes in inner and outer shear planes of a pin and may be instrumented with, for example, one or more strain gauges. The load pins 220 could be instrumented with strain gauges on the outer or inner surface of the or they could be instrumented with some other technology designed to react to the stress state in the pin. Load pins 220 may be disposed at joints on machine 100. In one exemplary embodiment, load pins 220 are disposed at joints connecting components of implement 104 and/or connecting the actuators to implement 104. Load pins 220 may be disposed at other joints about machine 100. Bending bridges 222 may be configured to measure strain in or along surfaces, such as, for example, along sides of stick 120. In one exemplary embodiment, the bending bridges may include, for example, four strain gauges. In one exemplary embodiment, the strain gauges on bending bridges 222 may be configured to provide one combined output.

A Sensor Control Unit (SCU) 224 associated with sensor network 208 may contain one or more processors and a memory device. SCU 224 may be configured to receive data signals from the sensors, process the data signals, and communicate data to controller 202. The one or more processors in SCU 224 may be a processor or a microprocessor, and may be configured to execute computer readable code or computer programming to perform functions, as is known in the art. The memory device in SCU 224 may be in communication with the one or more processors, and may provide storage of computer programs and executable code, including algorithms and data enabling processing of the data received from the sensors. In one embodiment SCU 224 may be configured to transmit time-stamped and synchronized information, along with sensed values to controller 202.

An Input Device Control Unit (IDCU) 226 may also contain one or more processors and a memory device, similar to SCU 224. IDCU 226 may be configured to receive data signals from operator input devices 142, process the data signals, and communicate at least one command data stream to controller 202. In one exemplary embodiment, IDCU 226 may be configured to communicate time-stamped and synchronized information, along with the command data stream to controller 202. It should be noted that controller 202 may be operable with IDCU 226 separately from SCU 224, or simultaneously working with both IDCU 226 and SCU 224. In addition, consistent with some embodiments, the functionalities of SCU 224 and IDCU 226 may be performed by single device.

In one embodiment, the information from IDCU 226 and/or SCU 224 may be used to classify a current operation of machine 100 as one of a plurality of known operations. For example, the current operation may be classified as one of a dig operation, a swing-to-truck operation, a dump operation, and a swing-to-dig operation, as will be described in more detail below. It is contemplated that controller 202 may then regulate machine 100 differently based on the classified operation. For example, when raising boom 114 with a fully loaded work tool 106 (e.g., during a dig operation), it may be desirable to increase the acceleration limits imposed on the extending movement of hydraulic actuator 118 to enhance machine efficiency and/or productivity. In contrast, high acceleration during boom lowering of an empty work tool 106 (e.g., during a return-to-trench segment) could cause work tool 106 to bounce uncontrollably. Accordingly, controller 202 may be configured to affect operational parameters of machine 100 differently based on the classified operation.

In another embodiment, the information from IDCU 226 and/or SCU 224 may be used to classify a plurality of operations of machine 100. For example, a remote server including controller 202 may receive data streams including information indicative of the movements of machine 100 and/or work tool 106 over a period of time. The period of time may be days, weeks, months, a year, or more. Controller 202 may apply advanced analytics algorithms to automatically determine the operations that machine 100 performed during that period of time. Understating which operations machine 100 performed may be used for determining an application profile of machine 100.

Figure 3:
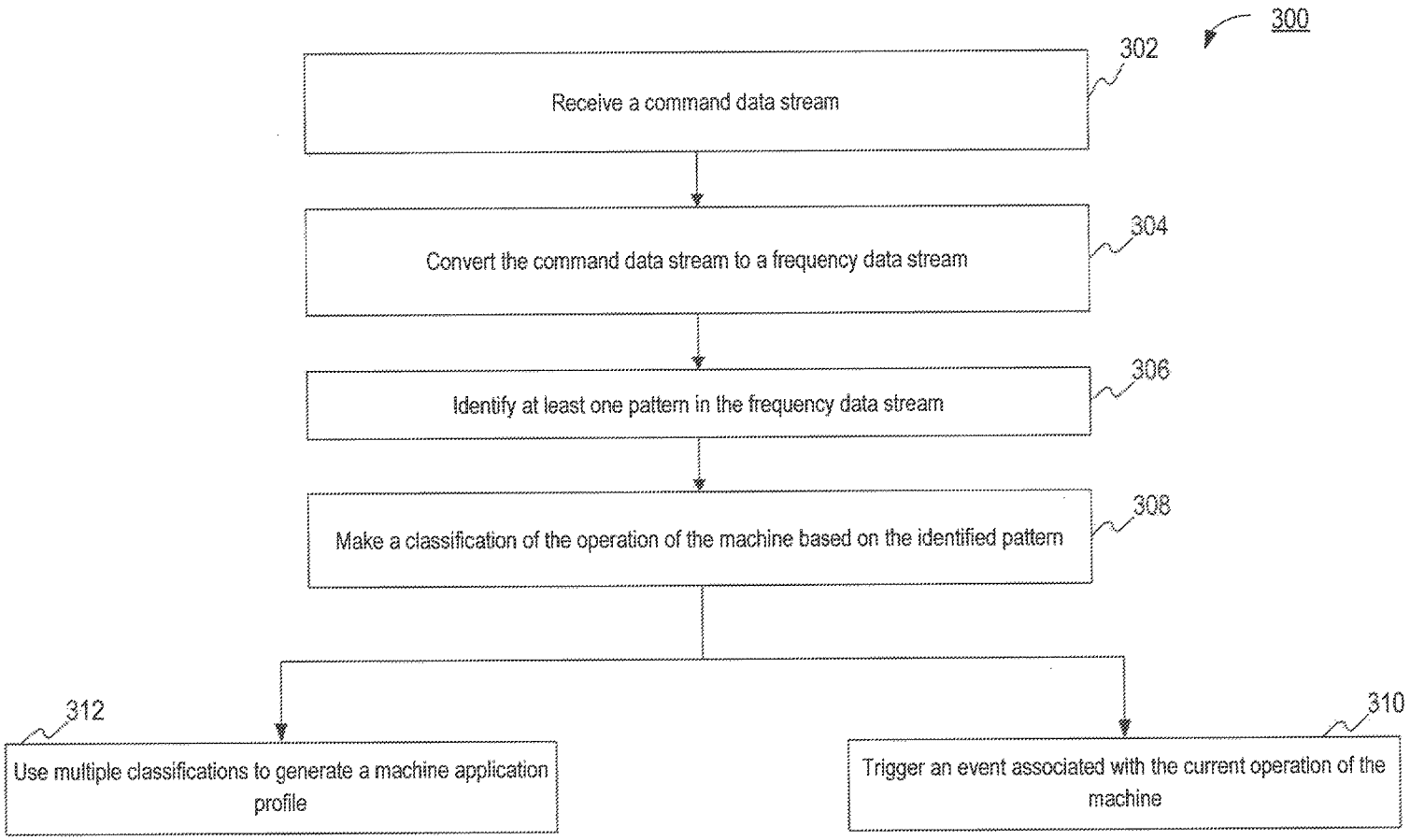
FIG. 3 is a flow chart showing an exemplary disclosed process that may be performed by the system of FIG. 2.

FIG. 3 illustrates an exemplary process performed by controller 202. FIG. 3 will be discussed in more detail below to further explain the disclosed concepts.

INDUSTRIAL APPLICABILITY

The disclosed systems and methods provide an accurate and reliable way for an on-board system to improve, in real-time, the productivity and efficiency of machine 100. For example, the on-board system can accurately estimate the velocity of an actuator (e.g., any one of hydraulic actuators 118, 124, or 126) based on information received from operator input device 142. In some embodiments, the on-board system can run a velocity-based control algorithm to efficiently guide operators to improve performance and increase productivity at applications such as grade leveling, back-filling, and pipe-laying that require high precision, accuracy and speed.

The disclosed systems and methods also provide an accurate and reliable way for an off-board system to determine a machine application profile. The machine application profile may be used for monitoring the health of machine 100 and for other purposes, such as product development, customer profiling, and marketing analytics. For example, the off-board system may determine information about customer usage of machines 100 by region, operator level, soil conditions, and more. In addition, the off-board system may use historical data (fuel consumption, productivity, efficiency, and health condition) to determine information that can correlate a specific operation of machine 100 with malfunctions and wear. Operation of system 200 will now be described with respect to FIG. 3.

FIG. 3 is a flow chart illustrating an exemplary process 300 for identifying operations of machine 100. Process 300 begins at step 302, when controller 202 receives a command data stream from IDCU 226. When process 300 takes place on-board machine 100, the command data stream may be received over direct communication lines between IDCU 226 and controller 202. Alternatively, when process 300 takes place off-board machine 100 (for example, at a remote server), the command data stream may be received wirelessly via a communication network. The command data stream may be associated with an input indicative of a desired movement of machine 100 or work tool 106. The command data stream may also associated with a period of time.

The command data received in step 302 may include different types of information. In a first embodiment, the received command data stream may include information from multiple operator input devices 142. For example, machine 100 and work tool 106 may be operated using a first joystick lever controlling a first actuator and a second joystick lever controlling a second actuator. In this example, the command data stream includes information from both the first joystick and the second joystick. In a second embodiment, the command data may include information from one or more operator input devices 142 and at least one sensor included in sensor network 208. For example, the at least one sensor may be associated with the movements of machine 100 and/or the movements of work tool 106, in this example, the information from the at least one sensor may be indicative of one or more of a pivoting position, an acceleration, a speed, a force, or a pressure associated with work tool 106. In a third embodiment, the received command data stream may include only information from at least one operator input device 142. For example, information about the velocity of an actuator may be estimated from joystick lever commands and not from any sensor.

At step 304 controller 202 converts the command data stream into a frequency data stream. By converting the command data stream from the time domain into the frequency domain, controller 202 may reveal repeated patterns of machine operations at both macro and micro levels. In one embodiment, controller 202 may apply known mathematical transformations to convert the time-based data stream (i.e., the command data stream) to the frequency-based data stream (i.e., the frequency data stream). For example, controller 202 may use a Fourier transform to convert the time-based command data stream into a sum of sine waves of different frequencies, each of which represents a frequency component. The frequency domain representation of the command data stream is the frequency data stream. In other examples, controller 202 may use other transformations, such as Laplace transform, Z transform, Wavelet transform, and others. In order to rapidly and efficiently convert the command data stream into a frequency data stream, controller 202 may use a Fast Fourier Transform (FFT) algorithm to compute the Discrete Fourier Transform (DFT) by factorizing the DFT matrix into a product of sparse (mostly zero) factors.

At step 306 controller 202 identifies at least one pattern in the frequency data stream. After the command data stream is converted to the frequency data stream, controller 202 may identify a pattern associated with a repeated activity of machine 100. It should be understood that the term "identifying a pattern" as used in this disclosure refers to recognizing in the frequency domain any sequence of values that follows certain set of rules or that has similarity to a previously determined sequence. In one embodiment, the previously determined sequence may be determined using machine learning algorithms on a large amount of sample data. Consistent with the present disclosure, when identifying patterns in the frequency domain, controller 202 may take into consideration the variance between command data streams generated by different operators. Controller 202 may also take into consideration the variance between the command data streams generated by the same operator working in different environments. For example, the representation of the operation "truck loading" in the command data stream may change based on the different soil conditions (e.g., compacted soil vs. re-handled soil).

At step 308 controller 202 makes a classification of the operation of machine 100 based on the identified pattern. The operation of machine 100 may include a plurality of distinct activities. For example, the operation "loading dirt" represented in FIG. 1 may include the activities: digging, collecting dirt, raising stick member 120, moving machine 100, and dropping the dirt into haul vehicle 102. These activities may be identified separately or together as part of a classified operation. Consistent with the present disclosure, making a classification of the operation of machine 100 may include comparing the identified pattern to a plurality of patterns associated with known operations. In one embodiment, the plurality of known operations includes a first set of known operations associated with a first type of machines and a second set of known operations associated with a second type of machines. When machine 100 belongs to the first type of machines, controller 202 may configured to make a classification only as one of the first set of known operations. For example, when machine 100 is a wheel loader, controller 202 may not search in the frequency data stream for a pattern associated with the operation "trenching," Likewise, when machine 100 is an excavator, controller 202 does not search in the frequency data stream for a pattern associated with the operation "dirt pushing."

In one embodiment, when the command data stream represents real-time movements of machine 100 or work tool 106, controller 202 can make a classification of a current operation of machine 100 as one of a plurality of known operations based on the identified pattern. In another embodiment. When the command data stream represents operations of machine 100 in a period of time, controller 202 can make classifications of a plurality of previous operations of machine 100 that happened in the period of time. Controller 202 is configured to make the classification based on information from the command data stream and other sources (e.g., user input), or solely from the information from the command data stream. With respect to the three examples of the different types of information that may be included in the command data stream, controller 202 can make the classification when the command data stream includes information from more than one operator input device 142, includes information from operator input device 142 and from sensor network 208, or includes only information from at least one operator input device 142.

At step 310 controller 202 triggers an event associated with the current operation of machine 100. Controller 202 may trigger the event when machine 100 is a manual machine, when machine 100 is an autonomous machine, and when machine 100 is a remote-controlled machine. In one embodiment, when the event is triggered, controller 202 may adjust an operational parameter of at least one actuator (e.g., hydraulic actuators 118, 124, or 126) based on the classification of the operation. For example, controller 202 may change at least one of the following parameters: acceleration rate, overall speed, force, and range of motion. In another embodiment, when the event is triggered, controller 202 may provide a notification to an operator of machine 100. When machine 100 is operated manually, the notification may be provided to a display in operator station 112. In the alternative. When machine 100 is remote controlled, the notification may be provided to a display in remote control station 140. In yet another embodiment, when the event is triggered, controller 202 may compare an operational parameter of at least one component to at least one predefined threshold associated with the current operation of machine 100. The at least one component may be different from the at least one actuator configured to move work tool 106. For example, when an operation of "back-filling" is identified, controller 202 may compare the value of engine RPM to make sure that it remains below 2000 RPM. When process 300 takes place on-board machine 100, triggering the event may include executing one of the actions listed above in real-time. Alternatively, when process 300 takes place off-board machine 100 (for example, at a remote server), triggering the event may include wirelessly transmitting instructions to machine 100, thereby causing the execution of one of the actions listed above in close to real-time.

At step 312 controller 202 uses multiple classifications to generate a machine application profile. In one exemplary embodiment, the machine application profile may be used to predict a potential failure of a component of machine 100. For example, controller 202 may use records of treatments and maintenance that may be stored in memory 204. For example, when a certain activity that may wear a certain component is identified, controller 202 may check the last time this component was examined. In another embodiment, the machine application profile may be used to determine information about a customer usage of machine 100. As mentioned above, machine 100 may be used for a variety of tasks. If, for example, controller 202 determines that a particular machine 100 is used only for two specific operations, it can provide the operator of the particular machine information based on the two specific operations. In yet another embodiment, the machine application profile may be used to determine ranking of performances of an operator of machine 100. For example, some operators may be very competent in some operations and less competent in other operations. This information may assist in work assignment. When process 300 takes place on-board machine 100, generating the machine application profile may include maintaining in memory 204 records of the activities that machine 100 preformed. When process 300 takes place off-board machine 100 (for example, at a remote server), controller 202 may generate a group of machine application profiles relating to a group of machines 100 and perform analysis on subgroups of these profiles. For example, when controller 202 is located at a remote server it may receive a plurality of command data streams from a plurality of machines 100 associated with a single customer. In this example, controller 202 may use the machine application profiles to determine a customer profile for the single customer. The customer profile may include a list of machines 100 it includes, the type and frequency of operations machines 100 preform, rankings of classified operations, ranking of the operators, and more.

It will be apparent to those skilled in the art that various modifications and variations can be made to the disclosed system 200. Other embodiments will be apparent to those skilled in the art from consideration of the specification and practice of the disclosed parts of the system. It is intended that the specification and examples be considered as exemplary only, with a true scope being indicated by the following claims and their equivalents.

What is claimed is:

1. A control system for a machine, comprising:

a work tool;

an operator input device configured to receive input indicative of a desired movement of the work tool and to generate a command data stream associated with the received input;

at least one actuator configured to move the work tool according to the command data stream; and a controller in communication with the operator input device and the at least one actuator, the controller being configured to:

convert the command data stream, including first information in a time domain into a frequency data stream, including second information in a frequency domain;

identify a pattern in the second information in the frequency domain;

classify a current operation of the machine as one of a plurality of known operations based on the identified pattern; and trigger an event associated with the current operation of the machine.

2. The control system of claim 1, wherein, when the event is triggered, the controller is further configured to adjust an operational parameter of the at least one actuator based on the classification.

3. The control system of claim 2, wherein adjusting the operational parameter includes changing at least one of the following parameters: acceleration rate, overall speed, force, and range of motion.

4. The control system of claim 1, wherein, when the event is triggered, the controller is further configured to provide a real-time notification to an operator of the machine.

5. The control system of claim 1, wherein, when the event is triggered, the controller is further configured to compare an operational parameter of at least one component to at least one predefined threshold associated with the current operation of the machine.

6. The control system of claim 5, wherein the at least one component differs from the at least one actuator configured to move the work tool.

7. The control system of claim 1, wherein:

the operator input device is a first joystick lever controlling a first actuator;

the control system further includes a second joystick lever controlling a second actuator; and the command data stream includes information from both the first joystick and the second joystick.

8. The control system of claim 1, wherein:

the plurality of known operations includes a first set of known operations associated with a first type of machines and a second set of known operations associated with a second type of machines; and when the machine belongs to the first type of machines, the controller is further configured to make a classification of the current operation of the machine only as one of the first set of known operations.

9. The control system of claim 1, further comprising at least one sensor associated with a movement of the work tool, wherein the controller is further configured to make the classification based on information from the at least one sensor and information from the operator input device.

10. The control system of claim 9, wherein the information from the at least one sensor is indicative of one or more of a pivoting position, an acceleration, a speed, a force, or a pressure associated with at least one of the work tool and the at least one actuator.

11. The control system of claim 1, wherein the controller is configured to make the classification based solely on information from the operator input device.

12. A method for identifying operations of a machine, comprising:

receiving a command data stream from at least one machine having an operator input device for controlling movements of the machine, wherein the command data stream is associated with a period of time;

converting the command data stream, including first information in a time domain into a frequency data stream, including second information in a frequency domain;

identifying a plurality of patterns in the second information in the frequency domain;

classifying a plurality of previous operations of the machine that happened in the period of time as one or more of a plurality of known operations based on the identified plurality of patterns; and using the classifications to generate a machine application profile.

13. The method of claim 12, further comprising:

using the machine application profile to predict a potential failure of a component of the machine.

14. The method of claim 12, further comprising:

using the machine application profile to determine information about a customer usage of the machine.

15. The method of claim 12, further comprising:

receiving a plurality of command data streams from a plurality of machines associated with a single customer; and using generated machine application profiles of the plurality of machines to determine a customer profile for the single customer.

16. The method of claim 12, further comprising:

using the machine application profile to determine ranking of performances of an operator of the machine.

17. The method of claim 12, further comprising:

receiving information from at least one sensor associated with the movements of the machine, wherein making the classifications is based on information from the operator input device and the information from the at least one sensor.

18. The method of claim 17, wherein the at least one sensor is configured to provide information indicative of movements of a work tool.

19. The method of claim 12, wherein making classifications of the plurality of previous operations of the machine is based solely on information from the operator input device.

20. A computer programmable medium having executable instructions stored thereon for completing a method for identifying operations of a machine, the method comprising:

receiving a command data stream from at least one machine having an operator input device for controlling movements of the machine, wherein the command data stream is associated with a period of time;

converting the command data stream, including first information in a time domain into a frequency data stream, including second information in a frequency domain;

identifying a plurality of patterns in the second information in the frequency domain;

classifying a plurality of previous operations of the machine that happened in the period of time as one or more of a plurality of known operations based on the identified plurality of patterns; and using the classifications to generate a machine application profile.

* * * * *